US006865933B1

(12) United States Patent
Einarson et al.

(10) Patent No.: US 6,865,933 B1
(45) Date of Patent: Mar. 15, 2005

(54) MULTI-LEVEL MONITORING WELL

(75) Inventors: Murray D. Einarson, 3806 El Centro Ave., Palo Alto, CA (US) 94306; Michael B. Casey, Woodacre, CA (US); Donald Winglewich, Marshall, CA (US)

(73) Assignee: Murray D. Einarson, Mountain View, CA (US)

( * ) Notice: Subject to any disclaimer, the term of this patent is extended or adjusted under 35 U.S.C. 154(b) by 0 days.

(21) Appl. No.: 09/241,744

(22) Filed: Feb. 1, 1999

Related U.S. Application Data

(60) Provisional application No. 60/073,316, filed on Feb. 2, 1998.

(51) Int. Cl.[7] ..... E21B 49/10

(52) U.S. Cl. ..... 73/152.23; 73/152.25; 73/863.33; 73/864.33; 73/864.64; 166/264; 166/384; 166/385; 166/387

(58) Field of Search ..... 73/863.33, 864.33, 73/864.63, 864.64, 864.73, 152.01–152.62; 166/264, 384, 385, 387, 245, 165

(56) References Cited

U.S. PATENT DOCUMENTS

| | | | | | |
|---|---|---|---|---|---|
| 3,537,485 | A | * | 11/1970 | March | 138/115 |
| 4,160,622 | A | * | 7/1979 | Colburn | 417/181 |
| 4,484,626 | A | | 11/1984 | Kerfoot et al. | 166/191 |
| 4,538,683 | A | * | 9/1985 | Chulick | 166/264 |
| 4,669,554 | A | | 6/1987 | Cordry | 175/59 |

(List continued on next page.)

FOREIGN PATENT DOCUMENTS

| | | | | |
|---|---|---|---|---|
| CA | 1304672 | | 7/1992 | |
| FR | 2773585 | * | 7/1999 | E21D/05/00 |

OTHER PUBLICATIONS

"An Integrated Ground Water Monitoring Program using Multilevel gas–Driven Samplers and Conventional Monitoring Wells", Andrzej Nazar, James Prieur, and Daniel Threlfall, Fall 1984, pp. 43–47.

StrataSampler Ads, TIMCO Mfg., Inc., Undated, 10 pgs.

"A Multiple–Packer/Standpipe System for Ground Water Monitoring in Consolidated Media", S. J. Welch and D. R. Lee, GWMR, Summer 1987, pp. 83–87.

"A Multilevel Device for Ground–Water Sampling and Piezometric Monitoring", J.F. Pickens, J. A. Cherry, G. E. Grisak, W. F. Merritt and B. A. Risto, Ground Water, Sept.–Oct. 1978, vol. 16, No. 5, pp. 322–327.

"Some Biases in Sampling Multilevel Piezometers for Volatile Organics", J.F. Barker, G.C. Patrick, L. Lemon and G.M. Travis, GWMR, Spring 1987, pp. 48–54.

(List continued on next page.)

*Primary Examiner*—Daniel S. Larkin
(74) *Attorney, Agent, or Firm*—Anthony Asquith & Co.

(57) ABSTRACT

An apparatus and methods are provided for monitoring a well and for obtaining fluid samples from below the ground. The apparatus includes a single-piece, extruded plastic well stock that extends from the surface of the ground to the lowest sampling depth. Plural sampling intervals are defined between the surface and the lowest sampling depth. Sampling intervals are defined by isolating sections of the borehole by using packers that seal the annular space between the well stock and the borehole. The well stock includes plural longitudinal chambers. Inlet holes are put into the well stock so that inlets for each interval admit fluid to only one longitudinal chamber. Inert sealant is injected below inlets to prevent fluid from spreading below a desired level. Instructions are placed into the longitudinal chambers to monitor fluids in the chambers or to retrieve samples, or alternatively, the well stock can be removed to obtain samples.

17 Claims, 8 Drawing Sheets

U.S. PATENT DOCUMENTS

| | | | | | |
|---|---|---|---|---|---|
| 4,735,095 | A | * | 4/1988 | Issel | 73/864.81 |
| 4,838,079 | A | * | 6/1989 | Harris | 73/152.18 |
| 5,117,685 | A | * | 6/1992 | Goldschild | 73/152.55 |
| 5,195,583 | A | | 3/1993 | Toon et al. | 166/187 |
| 5,226,495 | A | * | 7/1993 | Jennings, Jr. | 166/278 |
| 5,375,478 | A | * | 12/1994 | Bernhardt | 73/864.17 |
| 5,804,743 | A | * | 9/1998 | Vroblesky et al. | 73/863.23 |
| 5,817,926 | A | * | 10/1998 | Brandes | 73/40.5 R |
| 5,889,217 | A | * | 3/1999 | Rossabi et al. | 73/864.74 |
| 5,922,950 | A | * | 7/1999 | Pemberton et al. | 73/152.28 |
| 5,922,975 | A | * | 7/1999 | Butler et al. | 73/864.74 |
| 6,065,355 | A | * | 5/2000 | Schultz | 73/864 |
| 6,084,052 | A | * | 7/2000 | Aufdermarsh et al. | 528/125 |
| 6,263,972 | B1 | * | 7/2001 | Richard et al. | 166/381 |
| 6,561,227 | B2 | * | 5/2003 | Cook et al. | 138/98 |

OTHER PUBLICATIONS

"Multiple Completion Monitor Wells", Dennis Nakamoto, Frederick McLaren and Peter Phillips, Spring 1986, pp. 50–55.

"Multilevel Monitoring Well Installations", Kristen Henderson, WWJ, Mar. 1997, pp. 58–61.

"Multilayer Sampling in the Water–Table Region of a Sandy Aquifer", Kaplan et al., Ground Water, vol. 29, No. 2, Mar.–Apr. 1991, pp. 191–198.

"A Method for Installing Minature Multilevel Sampling Wells", W. Stites and L. Chambers, Ground Water, vol. 29, No. 3, May–Jun. 1991, pp. 430–432.

"A Comparison of Well Nests vs. Single–Well Completions", Thomas Johnson, GWMR, Winter 1983, pp. 76–78.

"Small– Vs. Large–Diameter Monitoring Wells", M. Rlnaldo–Lee, GWMR, Winter 1983, pp. 72–75.

"A Multilevel Ground Water Monitoring System for Casing Advance and Bedrock Drilling Methods", D.R. Boyle, GWMR, Spring 1992, pp. 105–115.

"Discussion of Papers", Vonhof et al., Ground Water, 1979, pp. 391–397.

"Waterloo System", Solinst, Sep. 1997, Advertising Brochure.

Westbay Instruments, Inc., Advertising Material, undated.

* cited by examiner

MULTI-LEVEL MONITORING WELL

This application relates to and claims priority from provisional application 60/073,316, filed Feb. 2, 1998.

BACKGROUND OF THE INVENTION

The present invention relates to systems for water monitoring and sampling, more particularly, to multi-level monitoring wells. A major objective of the present invention is to provide for enhanced determination of vertical gradients in pressure and water quality in groundwater.

Contamination of water is a major environmental concern. Toxic compounds can remain in groundwater, causing serious environmental and health problems, and can seep into surrounding soils. Quick, accurate evaluation of the contamination is critical, especially where there is a threat to health. Because contamination often spreads deep below the surface, and because there are variations in the vertical migration patterns of contaminants, identifying and treating contaminated water and soil can be problematic.

The extent and nature of a contaminant spill can be difficult to determine. The rapidity and nature of spread can be unpredictable, depending on the chemical composition and physical or biological properties of the contaminant, on water and soil conditions, on the weather, and on the characteristics of the soil and geologic formations. For example, consider a chemical spill or leak of multiple chemical components. Each may have a different solubility, and portions of the spill may encounter different water and soil conditions, causing them to spread different.

One approach to testing soil or water involves drilling or boring multiple holes at various locations and to various depths. Samples are then taken from the boreholes or instruments lowered in, and the results are analyzed to assemble an overall picture of the contamination. However, because of significant viability in dispersal of contaminants, the picture can be wrong or misleading. Also, this approach requires a lot of drilling, which takes time. Finally taking samples at just one depth in each hole is unsuitable for accurate assessments of vertical gradients, which requires monitoring at multiple levels within a single hole.

Unfortunately, sampling from multiple levels in the same hole has its own problems. Multi-level monitoring procedures can unintentionally alter the contaminant profiles they are trying to observe. In any system that involves placing equipment in a hole or well new drilling, the sampling equipment itself or water flow in the well can spread the contaminants, leading to inaccurate measurements. The borehole can crumble or erode, carrying contaminants between levels. To mitigate this, the annulus between the borehole and introduced equipment can be sealed off by backfiring or by the use of expandable packers (typically inflatable) that seal the hole at specified intervals to isolate the different sampling intervals.

One approach using es to seal off borehole intervals is described in U.S. Pat. No. 5,195,583 to Toon et al, "Toon" hereinafter. In Toon, packers include bentonite, which expands upon contact with groundwater naturally occurring in the borehole. However, this system can provide less than ideal results. If the borehole contains insufficient groundwater to expand the packer fully, the annulus will not be sealed, and the sampling intervals will not be isolated from each other. Also, the bentonite near the entrance port tends to become saturated and impermeable before the water can reach more distant bentonite, causing insufficient packer expansion. To counteract this tendency, the system of Toon includes means such as distributed blotting paper and very small plastic pipes to effect the even penetration of groundwater. Because these measures require specially placed water distribution means, they add to the time and expense of producing the packers. Furthermore, the distribution means are subject to displacement by jostling or installer error, which decreases the reliability of the system.

In another approach, a relatively large diameter hole is drilled, and pipes cut to different lengths are inserted into the hole. The insertion of separate pipes involves a costly repetition of several steps. Bundling tubes eliminates the need for repetitive insertion, but is also problematic. The bundled tubes must be carefully threaded into each section of casing, which is very time-consuming. Furthermore, individual tubes in a bundle often move relative to each other, complicating installation. Bundled tubes also permit fluid flow between the tubes, making it difficult to seal the well between intervals.

In another approach, described in U.S. Pat. No. 4,838,079 to Harris, pipe sections include interior elements that divide the sections into chambers. When the sections are joined, a sectioned pipe with longitudinal chambers is created. However, because the system of Harris is jointed, the sectioned pipe is vulnerable to leaking if strained or jarred. Furthermore, the reinforced joints can decrease the flexibility of the system complicating installation.

What is needed is a convenient, cost-effective apparatus and method for testing groundwater or other fluids at multiple depths with minimal perturbation of the sample distribution being measured.

SUMMARY OF THE INVENTION

A Multi-Level Monitoring Well (MLMW) is used to collect samples of groundwater, gas, soil vapor, or other fluid from the earth. Important features of the invention are (1) a central well stock that includes multiple longitudinal chambers and that is formed as a single piece, for example an extruded, multichamber pipe; (2) an improved expandable packer used to seal the borehole between the sampled zones. Additional screening and filtering reduce the introduction of aquifer sediment into the groundwater samples. In particular, the MLMW allows investigators to collect or take measurements from groundwater samples or soil vapor samples at multiple depths. The device is also designed to allow measurement of groundwater pressure (i.e., piezometric head) at various depths in one borehole. Other readings can be taken from instruments or sensors inserted into the longitudinal chambers.

DESCRIPTION OF THE PREFERRED EMBODIMENTS

Figures 1A, 1B:
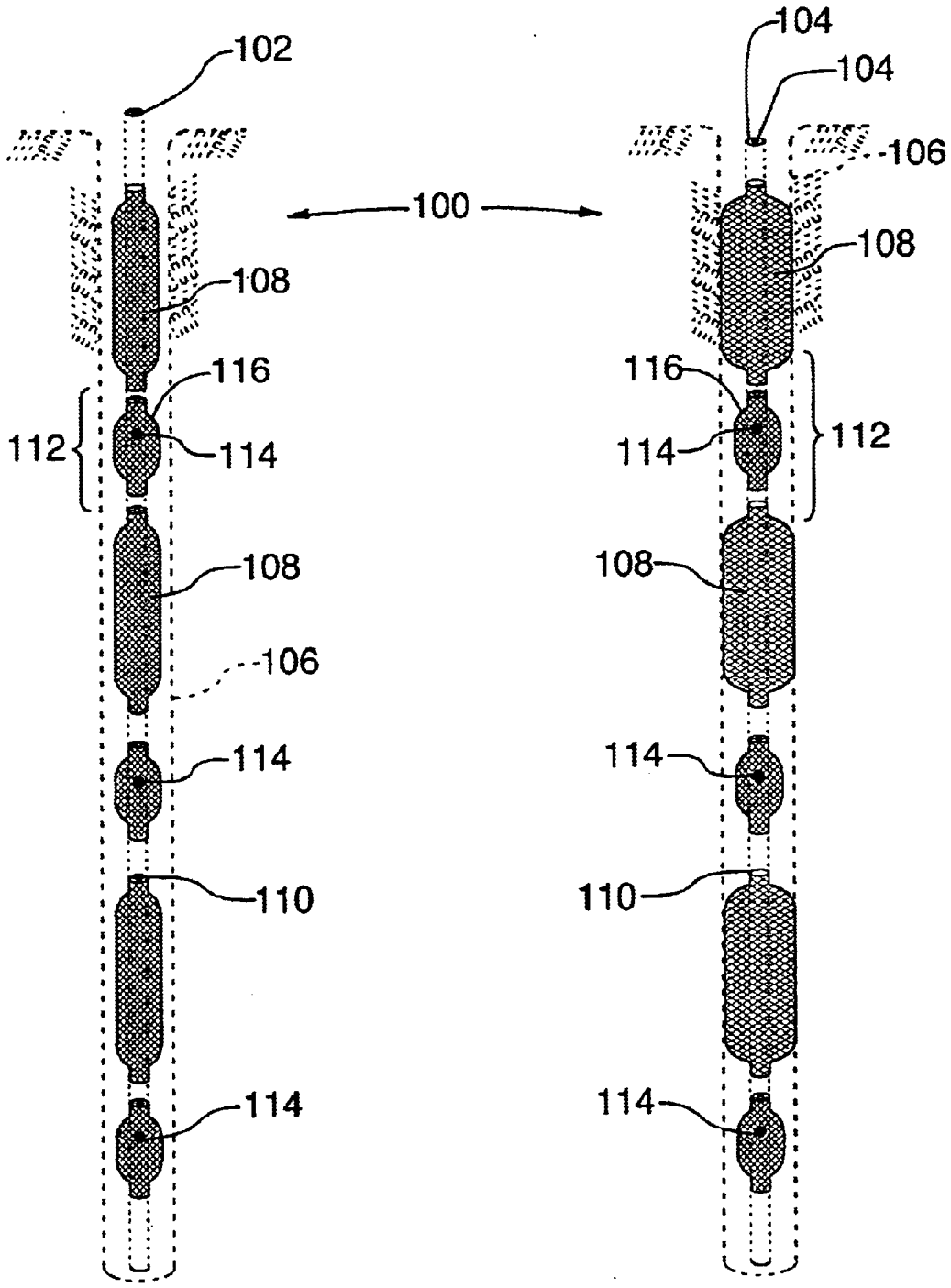
FIG. 1A is a cross-section of a system in accordance with the present invention, showing a multi-chambered central stock with sandpacks and uninflated packers in a borehole.
FIG. 1B shows the system of FIG. 1A with the packers inflated.

A system 100 includes a central well stock 102, containing two or more internal chambers 104, centered in an exploratory borehole 106, as schematically depicted in FIG. 1. Expandable packers 108 are spaced along the length of well stock 102. The packers are preferably bentonite or another expandable material contained within a permeable, expandable fabric sock (for example, of nylon or geotextile fabric) and surrounding the central well stock 102. Bentonite packers expand upon absorbing water. Accordingly, water can be provided to the packers, which will then expand to seal off different sections of borehole 106 from each other, as seen in FIG. 1B. Isolating sections allows independent samples or measurements to be taken from discrete regions. Packers 108 are preferably attached to well stock 102 by ties 110. Ties 110 can be nylon, plastic or metal, or metal or plastic clamps can be used. Alternative packers, such as a fluid-filled elastic toroid, can also be used.

Packers 108 define sampling intervals 112 between the packers. In a preferred embodiment, well stock 102 within sampling interval 112 includes a sample inlet 114. Sandpack socks 116 can be placed around the well stock and over the inlets, to filter the water entering the well stock. A cutaway close-up of sampling interval 112 is depicted in FIG. 2, showing a sandpack 116.

Figure 2:
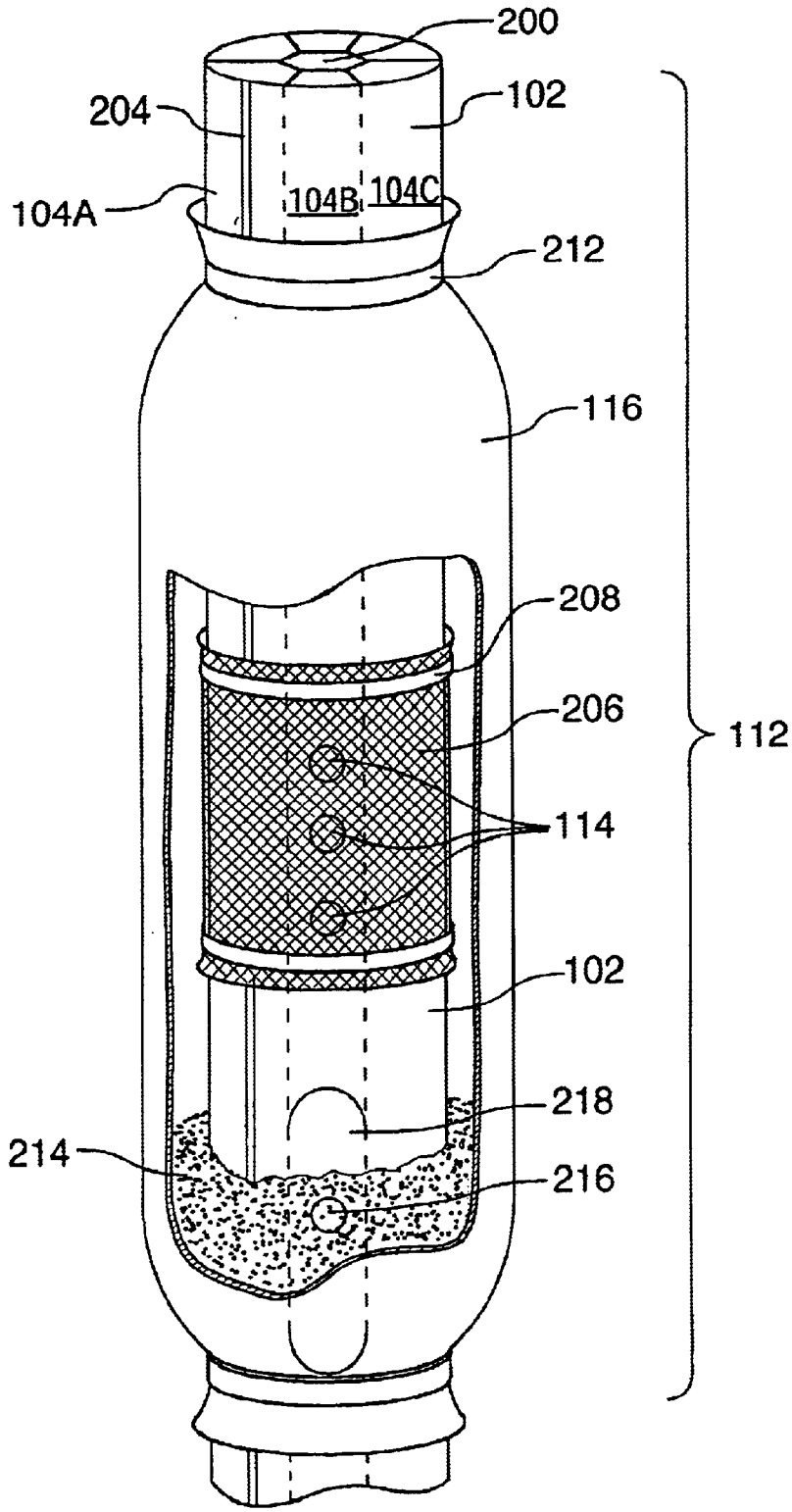
FIG. 2 is a cutaway, closeup view of a sandpack of FIGS. 1A and 1B showing features in more detail.

Multi-chambered well stock 102 includes plural longitudinal chambers 104, as shown in FIG. 2. In a preferred embodiment, well stock 102 is a continuous cylindrical tube of flexible polyethylene with seven longitudinal chambers, comprising a central hexagonal longitudinal channel 200 surrounded by six outer longitudinal chambers, as seen in FIG. 2. In the preferred embodiment, the diameter of the central hexagonal channel is roughly ¼ of the diameter of the well stock. In the preferred embodiment, well stock 102 is about 1.7" in diameter. In alternatives the well stock outer diameters can be as small as ¾ inch or as large as 8 inches. The well stock-packer system can be used with borehole or casing diameters as small as ¾ inch or as large as 12 inches. The outer longitudinal chambers are roughly trapezoidal in cross-section, with a rounded outer edge.

Well stock 102 is preferably an extruded, medium-density, flexible polyethylene. Flexibility allows the well stock to be on a spool and uncoiled into a well. Use of polyethylene for the well stock also creates a smooth outer surface, which can simplify coiling, storage and deployment of the well stock. At least in the case of the smaller sizes of well stock 102, several hundred feet of well stock can be coiled into a roughly 5' diameter coil, which can be easily unwound into a borehole. Coiling the stock also greatly simplifies well stock storage and transportation. the diameter of the well stock and the shape and number of longitudinal chambers can be varied to suit circumstances.

In a preferred embodiment, the well stock is a single continuous piece extending from the surface of the ground to the deepest sampling depth. In addition to the storage and deployment advantages already mentioned, having one continuous well stock eliminates the need for joints, which improves the sampling integrity; joints in such a system must be water tight, which can be expensive to implement and difficult to maintain. Joints can also add to the difficulty of deploying the MLMW, because jostling can decrease joint integrity.

Well stock 102 also includes a reference groove 204 to aid in the identification of specific chambers. Reference groove 204 is preferably scribed into the well stock; identifying marks or paint can also be applied to the well stock. Where manufacturing techniques allow, the well stock material itself can be color-coded.

In the sampling interval depicted in FIG. 2, three sampling inlets 114 are shown. For a given sampling interval, preferably all sampling inlets open into the same longitudinal chamber, in this case chamber 104B. In other embodiments, sampling inlets in the same sampling interval can open into different chambers. In the system shown in FIG. 2, sampling inlets 114 are covered with a wire mesh 206 secured to well stock 102 by nylon ties 208. Ties 208 can alternatively be made of metal or other material. A sand pack 116, secured by nylon ties 212 and containing sand 214, covers inlets 114. Wire mesh 206 and sand pack 116 filter the sample on its way into inlets 114. A sealant hole 216 is also shown in FIG. 2. A sealant is injected into sealant hole 216 to prevent liquid in chamber 104B from flowing below sealant hole 216.

Figure 3:
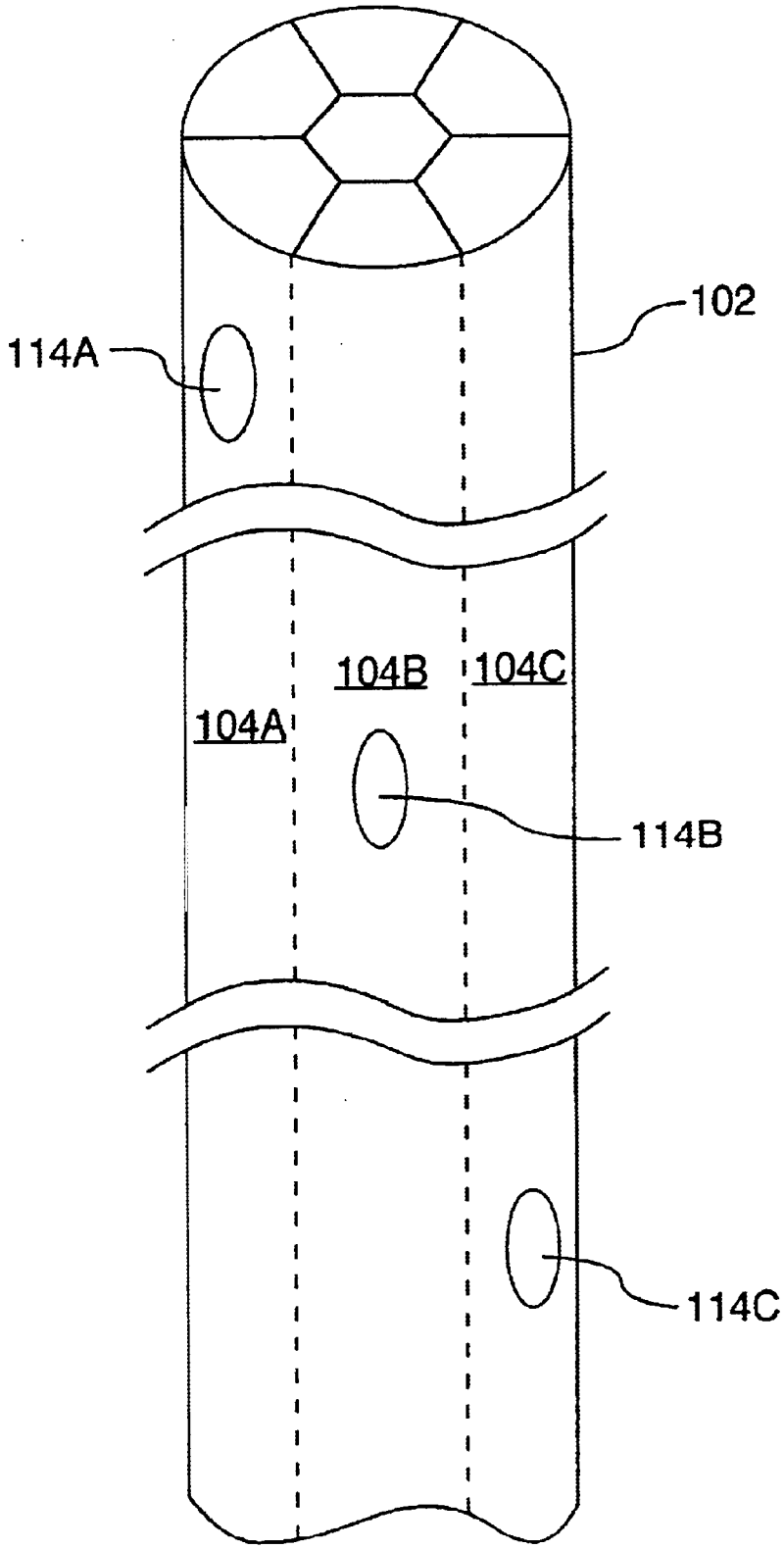
FIG. 3 is a depiction of the central well stock of FIGS. 1A and 1B schematically showing inlets at different points along the length of the well stock opening into separate chambers.

FIG. 3 is a depiction of the central well stock of FIGS. 1A and 1B. In FIG. 3, inlets 114 at different points along the length of the well stock, open into separate chambers. As schematically shown in FIG. 3, in actual use inlets 114A–114C would typically be farther apart than the scale of the drawing allows. Inlet 114A opens into chamber 104A, inlet 114B opens into chamber 104B, and inlet 114C opens into chamber 104C. In one embodiment, when installed, packers would be used to isolate inlets 114A, 114B and 114C into three respective sampling intervals. Sealant, preferably inert, can be selected into holes below at least one selected inlet. Enough inert sealant inserted to block the longitudinal chamber so that the fluid sample cannot pass the sealant. In alternative embodiments, packers are not used. Also in alternative embodiments, a user can define a greater number of sampling intervals than longitudinal chambers by isolating longitudinal portions with a longitudinal chamber by injecting scant above and below an inlet. The corresponding sections of the annulus between the well stock and the borehole wall can then be isolated by sealing using packers or, if the desired sampling intervals are not long enough for packers to be practical, then isolating layers, such as of grout, bentonite, or sand can be used. The isolating materials can be delivered by conventional methods such as tremie, or via one or more longitudinal chambers.

Figure 4A:
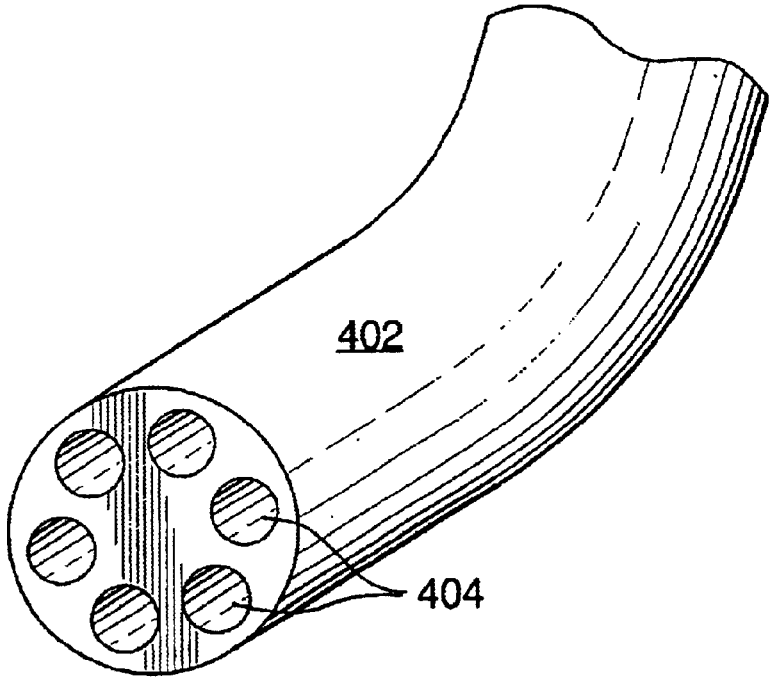
FIGS. 4A–4B show alternative embodiments of the multi-chamber stock.

Alternative embodiments for well stock 102 are shown in FIGS. 4A–4E. FIG. 4A shows extruded tubing 402 including internal openings 404. In the embodiment depicted in FIG. 4A, the tubing 402 and openings 404 have been extruded as a single piece. In a preferred embodiment, the openings have a diameter of roughly ⅝". Openings can be sized somewhat smaller or much larger, as sampling or monitoring needs dictate.

Figure 4B:
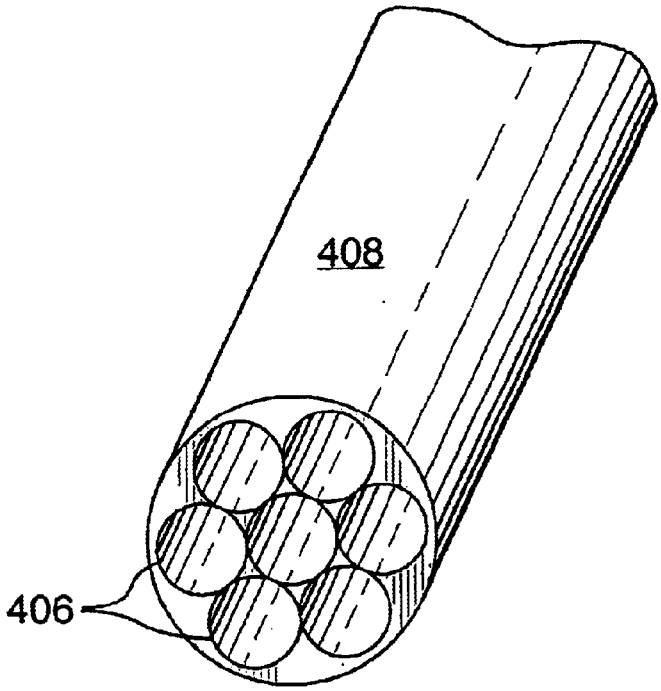

FIG. 4B shows small tubes 406 contained within an outer sheath 408. Small tubes 406 have an inner diameter of roughly ⅝". Outer sheath 408 can be an elastomeric material such as rubber, vinyl or silicone. Alternatively, outer sheath 408 can be a flexible plastic or metal. Small tubes 406 can be threaded into sheath 408 or, alternatively, tubes 406 can be bundled and sheath 408 wrapped around and sealed. Inlets can be cut, burned or otherwise provided in the tubes and outer sheath. In a preferred embodiment, sampling intervals are defined and inlets open into only one tube per sampling interval.

Figure 4C:
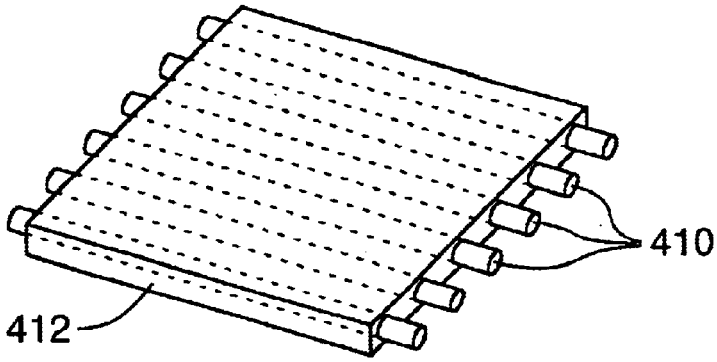
FIGS. 4C–4E depict the formation of an alternative embodiment of the multi-chamber stock.
Figure 4D:
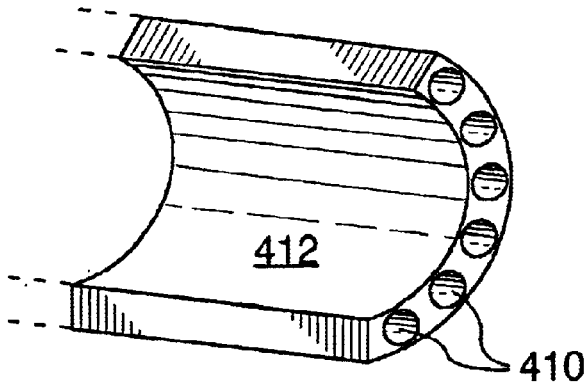
Figure 4E:
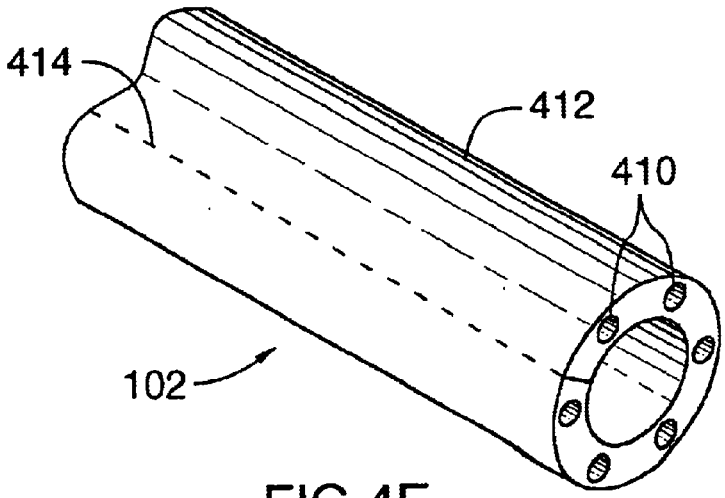

FIGS. 4C–4E show the formation of an alternative embodiment of a well stock, by embedding tubes 410 in a plastic, preferably polyethylene, block 412. In this embodiment, tubes 410 are embedded into block 412 by the application of heat. The polyethylene block is then heated and, as shown in FIG. 4D. In the final step, block 412 is formed into a cylinder and sealed with a seam 414, as depicted in FIG. 4E.

In an alternative embodiment, well stock 102 can be injection-molded around tubes or channels. In all embodiments of well stock 102, the internal chambers allow for the collection of groundwater or soil vapor samples using small-diameter pumps or bailers, and finding the depth of the static groundwater using a conductance meter or other water-level measurement tool. As will be apparent to those skilled in the art, other instruments, such as pressure transducers, geochemical sensors, tensiometers, suction lysimeters, dissolved oxygen meters, interface probes, check valves, and optical sensors can be placed within longitudinal chambers 104. A small camera can also be placed in a chamber.

After the desired groundwater sampling intervals have been determined (for example by evaluating subsurface hydrogeologic and geochemical data), inlets or ports in the internal chambers are made to allow groundwater or soil vapor to pass in. In a preferred embodiment, the sampling inlets open into only one chamber per sampling interval. However, the invention comprises plural sampling inlets opening into plural chambers in one interval. To reduce the entrance of sediment into the sampling chambers, the ports are covered with filtering material. Sample filtration can also be accomplished using a column of fine-grained sand that is positioned around the sample port inside of a geotextile filter fabric sock (or similar material) affixed to the monitoring well stock with ties, clamps, or other methods of attachment.

In one embodiment, a packer is used to seal the annular space between the central well stock and the borehole wall between the monitoring intervals to prevent cross-contamination. This is done using bentonite packers 108 that include mined bentonite chips or bentonite that has been compressed into pellets, contained within a permeable, expandable fabric sock affixed to the central well stock using ties 110, as shown in FIG. 1. The permeable fabric allows water to enter the packer from all sides, preventing the bentonite first exposed to water from becoming saturated and impermeable. Other permeable materials. Can be used for covering packers 108. The roughly spherical shape of the chips or pellets ensures slow expansion and allows the water to distribute evenly to all chips or pellets, Compressed pellets absorb water more quickly than uncompressed bentonite, allowing regulation of the water absorption and helping avoid such saturation and impermeability. In this way, the saturation difficulties discussed in U.S. Pat. No. 5,195,583 to Toon et al. are obviated, and no intra-packer water distribution system, such as Toon's blotting paper or tiny pipes, is necessary. The compressed bentonite pellets are preferably Volclay Pure Gold ¼ Inch Bentonite Tablets manufactured by CETCO (Colloid Environment Technologies Co.), located at 1500 West Shure Dr., Arlington Heights, Ill. 60004. Spherical bentonite pellets can be as small as grains of sand.

In a variation, the bentonite is formed into pellets that are coated in various thicknesses with a water-soluble material. As the water-soluble material dissolves around a pellet, that pellet expands. By using various thicknesses of coating, a time-release expansion can be used to delay hydration and expansion of the packer. The coated pellets are preferably Pelplug manufactured by PDS Co., P.O. Box 507, El Dorado, AR 71731. Another embodiment of the invention uses packers constructed of sheets of pressed bentonite mats (or other expandable sheets) that are wrapped around and are secured to the central well stock. They can be enclosed in fabric socks. Compressing the bentonite into mats also allows for even water distribution. The bentonite packers can be hydrated by exposure to groundwater, or a longitudinal chamber can be used to hydrate the packers. In the latter embodiment, holes are drilled into the chamber and spaced along the length of the well stock where the packers will be placed. The packers are placed on the well stock, and water can be introduced into the hydrating chamber at the surface. If the system is used with pneumatic packers or other devices that use fluid, the fluid can be introduced through one of the chambers, and the packer expansion can be controlled from the surface. In other alternative the packer sock can be of an elastomeric material such as rubber, silicone, or vinyl, and including plural openings to allow hydration.

The MLMW is installed in a borehole, temporary casing, or existing well. In a preferred method in accordance with the invention, the entire assembled MLMW is lowered into the ground during installation. The well stock can be uncoiled, the bentonite packers and optional sand packs attached, and the MLMW lowered into the existing hole. In a preferred embodiment, the diameter of a system including well stock, unhydrated packers, and sand-pack containers is roughly 3 inches, small enough for the assembled MLMW to be lowered into a small-diameter casing, well, or hole in the ground without obstruction, as shown in FIG. 1A.

When the bentonite packers contact water—either groundwater, water introduced into the well, or water introduced from the surface from a longitudinal chamber—they slowly expand over a period of several hours, filling and completely sealing the annular space between the central well stock and borehole or well casing, as seen in FIG. 1B. When there is a casing, it can be removed after the unhydrated well stock assembly is inserted into the hole.

The smooth exterior of the extruded polyethylene well stock allows the bentonite packers to be attached to the well stock virtually gap-free. The gap-free attachment prevents water from leaking between the packer and the well stock, thus maintaining sample integrity. The bentonite packers expand to fill irregularities in the borehole wall, also maintaining sample integrity. Using bentonite packers effectively seals the borehole without the use of time-consuming and potentially sample-disruptive tremie procedures. In alternative embodiment, fluid-filed packers or packers filled with other expandable materials can be used. Thus, the borehole (or well) is sealed and groundwater samples can be collected and groundwater pressures can be accurately measured in independent intervals in the borehole or well. Groundwater samples can be collected from the chambers using, for example, small-diameter bailers, check valve tubing pumps, or peristaltic pumps. Water levels can be measured using electronic well sounders. Pressure head can be measured using a piezometer or other transducer. Hydraulic tests, including slug, extraction, injection, and pressure pulse tests, can be performed. In situ geochemical analysis using geochemical probes inserted into the chamber can be performed.

Figure 5:
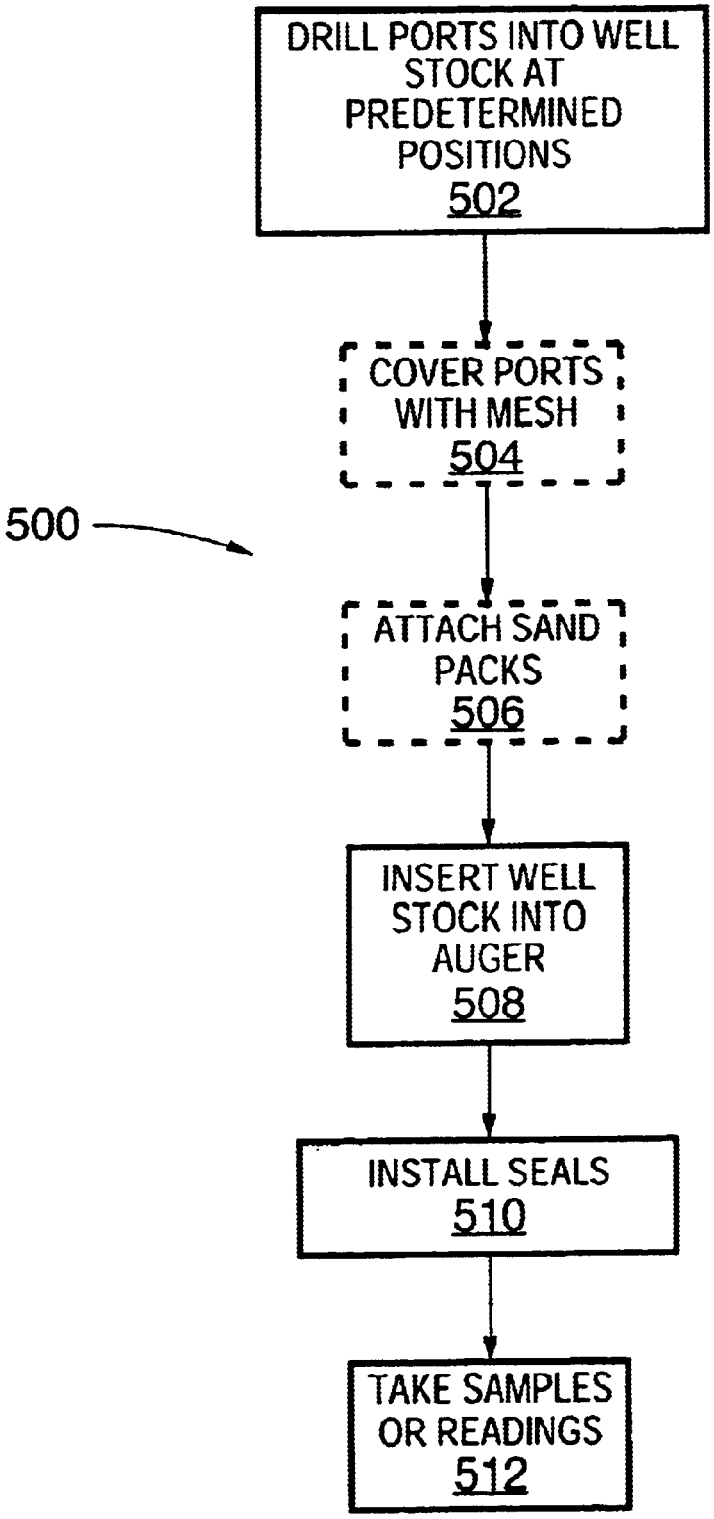
FIG. 5 is a flow chart of a first method of installing the MLMW in accordance with the present invention.

Three alternative methods of installation are preferred. A first method 500 is depicted in FIG. 5. After sampling intervals have been determined, for example, by evaluating surface hydrogeologic and geochemical data by reference to the boring log, ports are drilled, at a step 502, into selected chambers at appropriate points to allow groundwater or soil vapor to pass into the longitudinal chambers at desired depths when the well stock is installed. As has been discuss, in a preferred colt, only one chamber is used per sampling interval. The ports can be covered with filtering fabric, at an optional step 504, and sandpacks can be added, at an optional step 506. A borehole is drilled by hollow stem auger, rotary drill, or other means. Well stock 102 is inserted, at a step 508, inside a hollow stem auger or a rotary drilled boring. Alternating lifts of sand and bentonite seals are installed, at a step 510. The annular materials can be installed by tremie or dropped from the surface. Centralizers can be used to centralize the well stock in the auger or boring. Readings or samples are taken, at a step 512.

Figure 6:
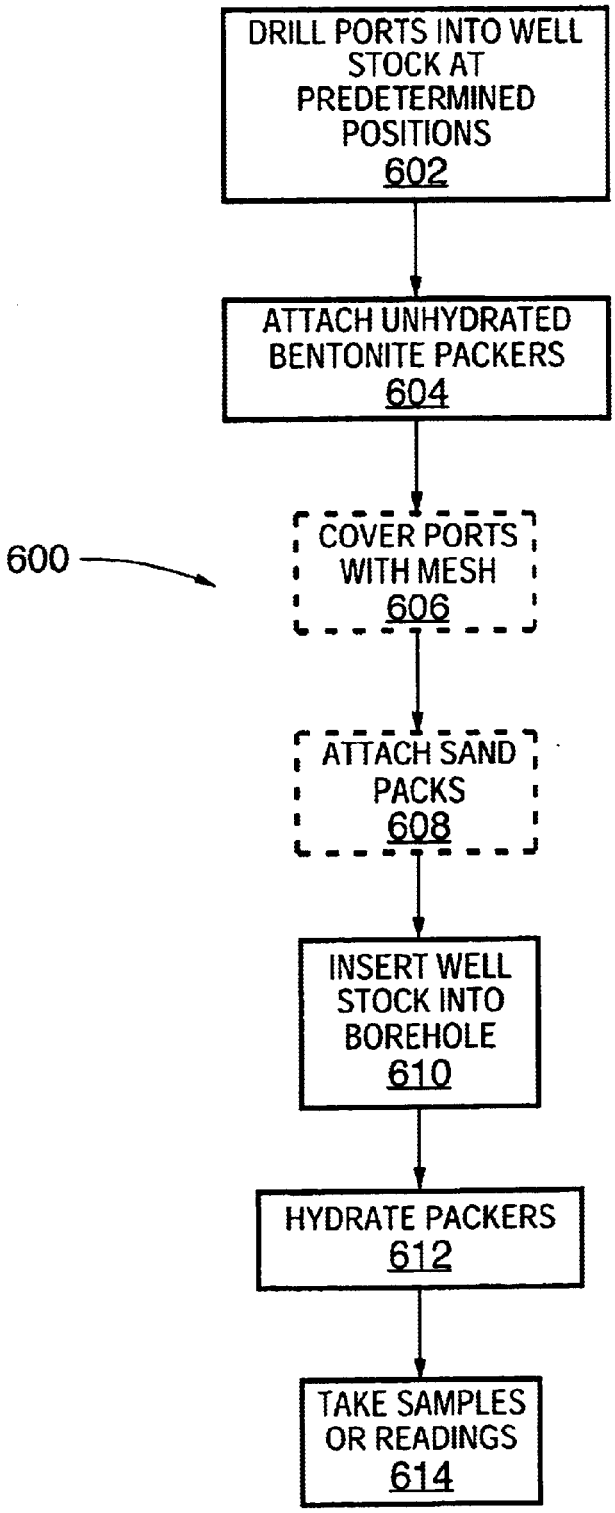
FIG. 6 is a flow chart of a second method of installing the MLMW in accordance with the present invention.

A second method 600 of installation is depicted in FIG. 6. Openings are made in well stock 102, at a step 602. At least one unhydrated bentonite packer is attached, at a step 604. Mesh filters 206 and sand packs 116 can optionally be attached, at steps 606 and 608, respectively. The well stock with unhydrated bentonite packers 108 and sand packs 116 attached is introduced, at a step 610, into a borehole, as schematically shown in FIG. 1A. Bentonite packers 108 are hydrated by native or introduced water, at a step 612, sealing the annulus between the stock and the hole, and defining at least one sampling interval. Samples and/or readings are then taken, at a step 614. This method is the preferred installation for use with direct push equipment.

Figure 7:
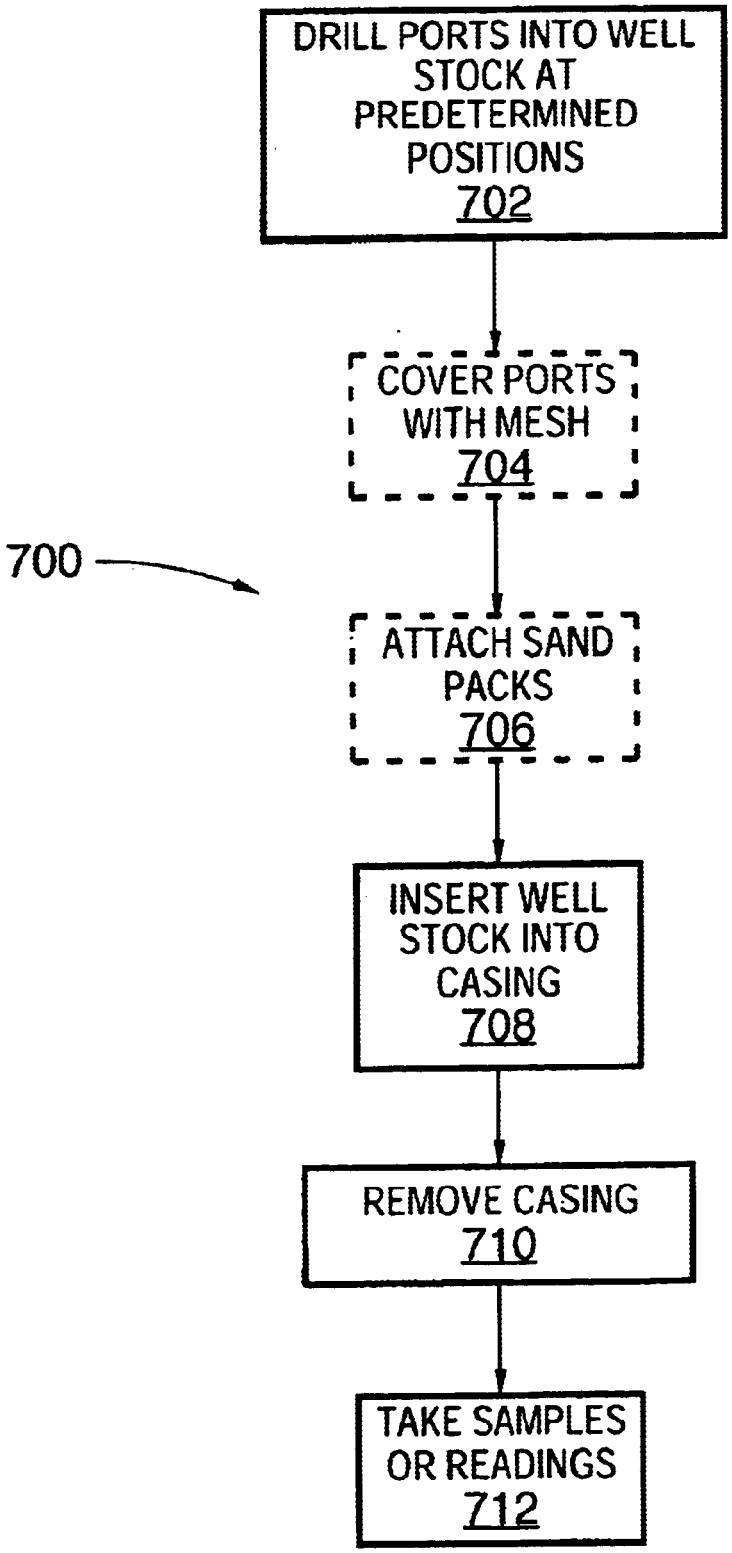
FIG. 7 is a flow chart of a third method of installing the MLMW in accordance with the present invention.

A third method 700 of installing the well stock is depicted in FIG. 7. This method is preferred in some unconsolidated soil formations such as homogeneous heaving sands where the hole is surrounded by a casing. Openings are made in well stock 102, at a step 702. Mesh filters 206 and sand packs 116 can optionally be attached, at steps 704 and 706, respectively. The well stock is inserted, at a step 708, down a casing. When the casing is withdrawn, the sand collapses around the well stock and mesh screens, supporting the well stock. The casing is withdrawn, at a step 710. Samples and or readings are then taken at a step 712.

The well stock can be manufactured of TEFLON (Polytetrafluoroethylene) other plastics besides polyethylene, or metal, depending on the user's needs and site characteristics. The well stock can be taken out, redrilled and/or resealed, and put back. Inlet holes and ports can be installed in ways other than drilling as for example, by cutting or by melting a hole into the plastic stock. Inlets can transmit fluid in either direction, in general, inlets can be used as ports to transit materials either into or out of the chamber. Materials need not flow, but can be injected under pressure. Materials transported in the well stock chambers from the surface need not be fluids. For example, sand or grout could be placed within a chamber at the surface and would flow (or be injected) down the chamber and out of an inlet at a desired depth. This procedure could be done at the completion of monitoring when removal of the multi-level well was desired. In this way, the multi-level well functions as a tremie pipe (i.e., the grout is pumped through the tubing as it is withdrawn to seal the borehole. Other materials, such as dyes or markers or remediation compounds, such as oxygen- or hydrogen-releasing compounds, can be injected or introduced through a longitudinal chamber of the well stock. Beneficial bacteria could also be introduced through the well stock.

Alternative embodiments of the well stock, including longitudinal chambers, and other components can be scaled up or down to the system limit dimensions. The longitudinal chambers can be larger or smaller than the roughly ⅝" diameter described supra. For example, in a eight-inch diameter well stock, each chamber can be approximately 1⅔inches in diameter. In a ¾ inch diameter well stock, the chambers can be less than ¼ inch in diameter.

Preferably, well stock 102 includes at least six longitudinal chambers, but the number of chambers can be increased or decreased depending on the user's needs. The chambers need not be hexagonal trapezoidal, or round, but can be any shape that suits the user's manufacturing capabilities, storage or transportation requirements, or in ground needs. The well stock can be used to send fluids in ether direction or in different directions simultaneously. For example, fluid dye from the surface can be injected down one longitudinal chamber while a sample is drawn out to the surface from another. The system can be used for sampling, monitoring, introducing and injecting. The system need not be installed vertically in a borehole, but can be installed in other orientations, such as horizontally in a trench. In one embodiment, the pellets can be coated with a material soluble in a solvent other than water, and the solvent can be introduced through a chamber in the well stock.

While there has been described what is believed to be the preferred embodiments of the invention, those skilled in the art will recognize that other and further modifications may be made thereto, and it is intended to claim all such embodiments that fall within the true scope of the invention.

What is claimed is:

1. An apparatus for in-ground fluid sampling comprising a flexible tube of unitary construction having a plurality of longitudinal chambers, at least one of the longitudinal chambers having an aperture for admitting the fluid into the at least one longitudinal chamber.

2. The apparatus of claim 1 wherein the flexible tube further comprises a continuous extruded column.

3. The apparatus of claim 1 wherein the flexible tube further comprises a non-jointed column.

4. The apparatus of claim 1 wherein the flexible tube further comprises a flexible polymeric material.

5. The apparatus of claim 1 wherein the flexible tube further comprises a cylindrical outer surface.

6. The apparatus of claim 1 wherein the longitudinal chambers are coextensive with the flexible tube.

7. A method of obtaining data from depth disorete fluids disposed in an in-ground hole comprising the steps of:

installing a flexible tube of unitary construction in the in-ground hole, the flexible tube including a plurality of longitudinal chambers, at least one of the longitudinal chambers having an aperture for admitting the fluid into the at least one longitudinal chamber;

and collecting the data.

8. The method of claim 7 further comprising the steps of:

determining a sampling depth; and creating the said aperture in the flexible tube to correspond with the sampling depth upon installation of the flexible tube.

9. The method of claim 7 further comprising the step of spacedly attaching at least one packer to the flexible tube.

10. The method of claim 7 further comprising the step of attaching a filter over the aperture.

11. The method of claim 7 wherein the step of collecting the data further comprises inserting a down-hole instrument in at least one of the plurality of longitudinal chambers.

12. The method of claim 7 wherein the step of collecting the data further comprises collecting a physical sample of the fluid from at least one of the longitudinal chambers.

13. Apparatus for taking a sample from a borehole, wherein:

the apparatus includes a length of continuous multi-channel (C-M-C) tubing;

the C-M-C tubing is an extrusion in a plastic material, having an extruded profile;

the length of C-M-C tubing is one single unitary continuous length of extruded plastic;

the length of C-M-C tubing fits lengthwise down the borehole, from a support at the surface, to a depth D of the borehole;

the profile of the C-M-C tubing includes an outer wall, which encloses a hollow interior;

the profile includes dividing walls, which separate the hollow interior into N cavities;

over the length of C-M-C tubing, the N cavities of the profile define N longitudinal channels;

the apparatus includes a sampling port P1, which is located, when the length of C-M-C tubing is in the borehole, at a depth D1 of the borehole;

the sampling port P1 comprises an opening in the outer wall of the C-M-C tubing, into channel N1 of the N channels;

the sampling port P1 is so structured that a sample of liquid, from the borehole, outside the C-M-C tubing, at the depth D1, can pass through into the channel N1;

the C-M-C tubing is flexible enough that the C-M-C tubing can be wrapped in a coil of diameter C;

the diameter C is small enough that the single unitary continuous length of the C-M-C tubing, so coiled, is transportable to the borehole site;

the dividing walls are sufficient in number and robustness as to mechanically brace the profile of the C-M-C tubing when the length of C-M-C tubing is coiled to the diameter C; and the C-M-C tubing is of such structure that, having been coiled to the diameter C for transport, the single unitary continuous length can be uncoiled, and fed down into the borehole, from the surface.

14. Apparatus of claim 13, wherein:

the apparatus includes a sampling port P2, which is located, when the C-M-C tubing is in the borehole, at a depth D2 of the borehole;

the sampling port P2 comprises an opening in the outer wall of the C-M-C tubing, into channel N2 of the N channels;

the sampling port P2 is so structured that a sample of liquid, form the borehole, outside the C-M-C tubing, at the depth D2, can pass through into the channel N2;

the sampling port P1 is separated vertically from the sample port P2, along the length of C-M-C tubing; and the apparatus includes a packer, which fits annularly between the C-M-C tubing and the wall of the borehole, and is effective to isolate the sampling port P1 at depth D1 from the sampling port P2 at depth D2;

whereby samples can be drawn independently from the two depths D1 and D2.

15. Apparatus of claim 13, wherein:

the outer wall of the C-M-C tubing is formed as a right cylinder; and the profile includes a central hub, and the dividing walls are arranged as spokes, emanating substantially radially from the central hub to the outer wall;

whereby the cavities formed between the spokes, and are sector-shaped.

16. Apparatus of claim 15, wherein, in the profile, the spokes are radial, straight, and of constant thickness, between the central hub and the outer wall.

17. Apparatus of claim 15, wherein:

the central hub is hollow in profile, defining a central cavity;

and the spokes are six in number, whereby the profile includes, with the central cavity, a total of seven cavities.

* * * * *